United States Patent [19]

Ebihara

[11] Patent Number: 4,687,098

[45] Date of Patent: Aug. 18, 1987

[54] STAPLE CASSETTE

[75] Inventor: Yoshiyuki Ebihara, Tokyo, Japan

[73] Assignee: Etona Company, Limited, Tokyo, Japan

[21] Appl. No.: 899,679

[22] Filed: Aug. 25, 1986

[30] Foreign Application Priority Data

Mar. 18, 1986 [JP] Japan ..... 61-58028

[51] Int. Cl.[4] ..... B65D 85/24

[52] U.S. Cl. ..... 206/340; 221/198; 221/279; 227/120; 227/DIG. 1; 220/346

[58] Field of Search ..... 206/340, 341; 221/198, 221/279; 227/120, DIG. 1; 220/346

[56] References Cited

U.S. PATENT DOCUMENTS

| | | | |
|---|---|---|---|
| 463,256 | 11/1891 | Side | 221/279 |
| 580,556 | 4/1897 | Reinhold | 227/120 |
| 733,825 | 7/1903 | Edgar et al. | 221/198 |
| 1,671,285 | 5/1928 | Hanna | 221/279 |
| 3,115,991 | 12/1963 | Caren et al. | 221/198 |
| 3,278,107 | 10/1966 | Rygg | 206/340 |
| 3,861,563 | 1/1975 | Lisbin et al. | 221/279 |
| 4,192,422 | 3/1980 | Kotyuk | 220/346 |
| 4,234,101 | 11/1980 | Pastorz | 221/279 |
| 4,249,346 | 2/1981 | Johnson | 220/324 |
| 4,298,139 | 11/1981 | Radek | 221/198 |

*Primary Examiner*—Joseph Man-Fu Moy

*Attorney, Agent, or Firm*—Wood, Dalton, Phillips, Mason & Rowe

[57] ABSTRACT

The present invention provides a staple cassette including a relatively elongated body having a hollow portion extending throughout the length of the body and having a pair of staple driving apertures formed in the body adjacent to its forward end and aligned with each other and feeder means in the hollow portion for resiliently urging a set of staples in the hollow portion toward the forward end thereof, the feeder means including a feeder element engaging the rearward end of the staple set housed in the hollow body portion, a coil spring mounted in the hollow body portion to engage the rearward end of the feeder element and a cap mounted on the cassette body to close its rearward opened end and engaging the opposite end of the coil spring, the cap including a pair of projections adapted to snap-fit into the respective openings on the sidewalls of the cassette body when the cap is pressed into the rearward opened end of the cassette body.

2 Claims, 4 Drawing Figures

STAPLE CASSETTE

BACKGROUND OF THE INVENTION

1. Field of the Invention

The present invention relates to a new cassette in which a set of staples is pre-loaded.

2. Description of the Prior Art

Various types of staplers are currently used through a broad range of application. In the prior art staplers, when a preloaded set of staples has been used, a new set of staples is loaded in a stapler. A set of staples described herein comprises a plurality of inverted U-shaped staple elements which are together joined side-to-side. On loading, the set of staples must carefully be handled since the staples can easily be disassembled due to any external slight force. The inventors has proposed a cassette type stapler to overcome the above problem on loading. However, the cassette itself should be simple in construction and have means for properly feeding the set of staples toward a driving aperture through which each of the staples is to be driven outwardly.

SUMMARY OF THE INVENTION

It is therefore an object of the present invention to provide a staple cassette suitable for use in the cassette type stapler, which is simple in construction and which includes means for feeding staples properly and positively.

To this end, the present invention provides a staple cassette comprising a relatively elongated body having a longitudinally extending hollow portion and having a pair of aligned staple driving apertures formed in said body adjacent to its forward end and feeder means housed in said hollow portion for resiliently urging a set of staples in said hollow portion toward its forward end, said feeder means including a feeder element engaging the rearwardmost one of said staples in said hollow body portion, a coil spring in said hollow body portion to engage the rearward end of said feeder element and a cap engaged by the opposite end of said coil spring and disposed to close the rearward opened end of said cassette body, said cap including a pair of projections laterally extending from each side of said cap, said cassette body including a pair of openings formed therein at each side, into which the respective projections of said cap are snap-fitted when said cap is pressed into the rearward opened end of said cassette body.

In a preferred embodiment of the present invention, the staple cassette further comprises a rod longitudinally extending from the inner face of said cap, said rod further extending longitudinally through said coil spring with the forward end inserted into an opening formed in said feeder element therethrough.

DESCRIPTION OF PREFERRED EMBODIMENT

Figure 1:
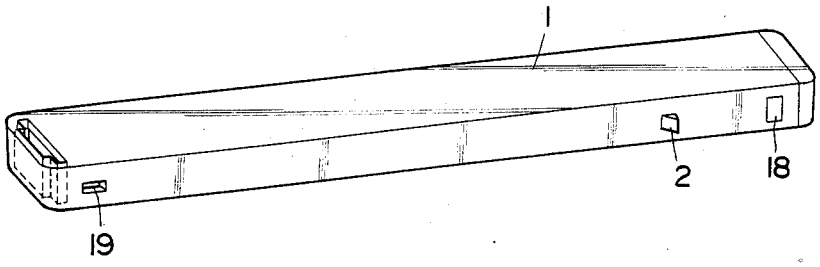
FIG. 1 is a perspective view of one embodiment of a staple cassette constructed in accordance with the present invention.
Figure 2:
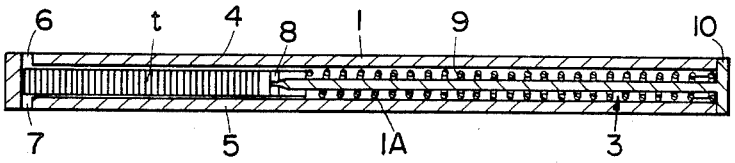
FIG. 2 is a longitudinal section of the staple cassette shown in FIG. 1.
Figure 3:
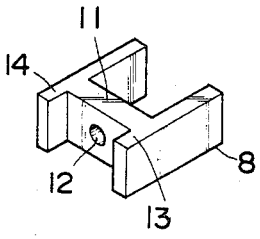
FIG. 3 is a perspective view of a feeder element used in the staple cassette shown in FIGS. 1 and 2.
Figure 4:
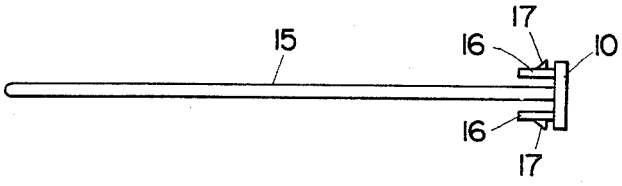
FIG. 4 is a side view of a cap with a rod, used in the staple cassette shown in FIGS. 1 and 2.

Referring first to FIGS. 1 and 2, there is shown a staple cassette constructed in accordance with the present invention, which comprises an elongated box-like body 1 including a hollow portion 1A extending throughout the length of the body 1. The hollow portion 1A is adapted to receive a set of staples t. The cassette body 1 may include a projection 2 (only one shown) formed on each side thereof, which is adapted to engage the corresponding recess (not shown) formed on a stapler frame (not shown) at the corresponding sidewall thereof to hold the staple cassette in place within the stapler frame. Alternatively, such a projection may be formed on the staple frame while the recess may be formed on the staple cassette. Furthermore, any other type of holding means may be utilized in the present invention, if desired.

The set of staples t housed in the cassette body 1 is resiliently urged by means of a feeder 3 toward the forward end of the body 1 wherein the forwardmost staple of the staple set will be aligned with staple driving apertures 6 and 7 which are respectively formed on the top and bottom walls 4 and 5 of the cassette body 1 adjacent to the forward end thereof and located to align with each other in a direction substantially perpendicular to the top and bottom walls 4 and 5 of the body 1. When an actuating member (not shown) on a stapler handle (not shown) is moved through the aligned apertures 6 and 7 of the cassette body 1, a staple is separated from the set of staples t and driven outwardly from the cassette body 1. Thereafter, the driven staple is engaged by an anvil (not shown) on a stapler base (not shown) to deform into a configuration which will be taken when it binds articles such as sheets of paper. The components and process described can easily be understood by a person skilled in the art without further description.

The feeder 3 comprises a forward feeder element 8 engaging the rearward end of the staple set t, a coil spring 9 for resiliently urging the feeder element 8 toward the forward end of the cassette body 1 and a cap 10 engaging the rearward end of the coil spring 9 and fitted into the rearward opened end of the cassette body 1.

The feeder element 8 is of H-shape and includes a small aperture 12 formed therethrough at the central connection 11. The feeder element 8 has two leg portions 13 and 14 which extend parallel to each other. The feeder element 8 is received in the hollow portion 1A of the cassette body 1 such that the rearward end of the staple set t will be engaged by the ends of the feeder leg portions 13 and 14.

A rod 15 is fitted at its tip into the small aperture 12 of the feeder element 8 and extends from the inner face of the cap 10 along the length of the cassette body 1. The coil spring 9 is mounted around the rod 15 as shown in FIG. 2. The coil spring 9 engages at one end the back face of the central connection 11 of the feeder element 8 with the opposite end thereof engaging the inner face of the cap 10.

When the cap 10 is mounted on the cassette body 1 at its rearward opened end, thus, the spring 9 will resiliently urge the feeder element 8 and thus the staple set t toward the forward end of the hollow portion 1A of the cassette body 1.

The cap 10 includes a pair of parallel lugs 16 extending inwardly from the inner face of the cap 10 at the opposite sides. Thus, these lugs 16 are located on and spaced parallel from the opposite sides of the rod 15. Each of the lugs 16 has a projection 17 extending laterally from the outer side thereof. When the cap 10 is mounted on the rearward end of the hollow portion 1A of the cassette body 1, the lugs 16 are resiliently deflected inwardly in engagement with the inner sidewalls of the cassette body 1. When the projections 17 reach openings 18 (FIG. 1) formed on the sidewalls of the cassette body 1 at the corresponding locations, they are snap-fitted into the respective openings 18 to firmly hold the cap 10 on the cassette body 1. It is further preferable to form a small window 19 on at least one of the sidewalls of the cassette body 1 adjacent to the forward end thereof such that the remaining staples can visibly be observed by an operator. Such a window will be omitted if the cassette body 1 is made of any transparent plastic material.

On operation, a cassette pre-loaded with a set of staples is mounted in the stapler frame or cassette holder (not shown). If all the staples have completely been used in this cassette, another new cassette pre-loaded with a set of staples may be mounted on the stapler.

The present invention can solve one of the important problems in the prior art encountered on loading of staples in accordance with a novel and unique concept completely distinguished from that of the prior art. Particularly, the staple cassette is very advantageous for unskilled persons including infants, old persons and physically handicapped persons since the staple cassette can easily and simply be mounted in the stapler.

I claim:

1. A staple cassette comprising a relatively elongated body having a hollow portion extending throughout the length of said body and having a pair of staple driving apertures formed in said body adjacent to its forward end and aligned with each other, a pair of openings formed in the sidewalls of the body adjacent its rearward opened end, and feeder means in said hollow portion for resiliently urging a set of staples in said hollow portion toward the forward end thereof, said feeder means including a feeder element engaging the rearward end of said staple set housed in said hollow body portion, a coil spring mounted in said hollow body portion to engage the rearward end of said feeder element and a cap mounted on said cassette body to close its rearward opened end and engaging the opposite end of said coil spring, said cap including a pair of projections adapted to snap-fit into the respective pair of openings on the sidewalls of said cassette body when said cap is pressed into the rearward opened end of said cassette body.

2. A staple cassette as defined in claim 1 wherein said feeder means also includes a rod extending from the inner face of said cap along the length of said cassette body, said coil spring being mounted around said rod, the forward end of said rod being inserted into an opening formed in said feeder element therethrough.

* * * * *